United States Patent [19]

Kawka et al.

[11] 4,386,973

[45] Jun. 7, 1983

[54] VACUUM CARBURIZING STEEL

[75] Inventors: Richard J. Kawka, Roselle; Daniel H. Herring, Elmhurst; Philip Roth, Highland Park; Richard J. Sitko, Norwood Park Township, Chicago County, all of Ill.

[73] Assignee: General Signal Corporation, Stanford, Conn.

[21] Appl. No.: 261,761

[22] Filed: May 8, 1981

[51] Int. Cl.[3] ..... C21D 1/48

[52] U.S. Cl. ..... 148/16.5; 148/16.6; 148/16.7

[58] Field of Search ..... 148/16, 16.5, 16.6, 148/16.7

[56] References Cited

U.S. PATENT DOCUMENTS

| | | | |
|---|---|---|---|
| Re. 29,881 | 1/1979 | Westeren et al. | 193/23 |
| 2,334,652 | 11/1943 | Schmitt | 148/16.5 |
| 2,673,821 | 3/1954 | Stutzman | 148/16.5 |
| 3,201,290 | 8/1965 | Wyss | 148/16.5 |
| 4,124,199 | 11/1978 | Jones et al. | 266/88 |
| 4,145,232 | 3/1979 | Solomon | 148/20.3 |
| 4,154,629 | 5/1979 | Asai et al. | 148/16.5 |
| 4,160,680 | 7/1979 | Novy et al. | 148/16.5 |
| 4,168,186 | 9/1979 | Limque et al. | 148/16.5 |
| 4,236,941 | 12/1980 | Main | 148/16.5 |
| 4,249,965 | 2/1981 | Schultz | 148/16.6 |

*Primary Examiner*—John P. Sheehan

*Attorney, Agent, or Firm*—Oblon, Fisher, Spivak, McClelland & Maier

[57] ABSTRACT

A method of carburizing steel comprising carburizing steel under vacuum utilizing as the carburizing gas an aliphatic alcohol having 1 to 4 carbon atoms, preferably methanol and natural gas additions.

8 Claims, 9 Drawing Figures

VACUUM CARBURIZING STEEL

BACKGROUND OF THE INVENTION

1. Field of the Invention

This invention relates to a process for vacuum carburizing of steel.

2. Description of the Prior Art

Carburizing is the introduction of additional carbon to the surface of a steel part in order to effect case hardening. In gaseous carburizing, an endothermic gas, which contains carbon monoxide and hydrogen, is used as a carrier gas to displace the air in the furnace.

A hydrocarbon-containing gas such as natural gas, propane or butane is added to the endothermic gas in varying quantities. The carbon monoxide from the endothermic gas and the hydrocarbon react to form nascent carbon atoms, which in turn combine with the iron in the steel to form iron carbide. The iron carbide provides the case.

The steel is exposed to the carburizing atmosphere at high temperatures, e.g., temperatures in the austenitic range for the steel in question, for a predetermined time to achieve the desired depth of carbon penetration into the steel surface. This depth is called the depth of the case.

Carburized or case hardened steel has many important uses because of its desirable properties. The case provides extreme hardness at the surface while the inner portion, or core, beyond the case is relatively soft and ductile. Therefore, case hardened steel has excellent wear properties in combination with the toughness of the core.

In conventional gas carburizing furnaces, a carburizing atmosphere is force circulated by a fan system over the steel in the chamber at atmospheric pressures. Usually, a hydrocarbon gas, such as is found in natural gas, is utilized in combination with a carrier gas, such as an endothermic gas, as the carburizing atmosphere. The carburizing atmosphere is circulated in the furnace for a predetermined time and under predetermined conditions to carburize the steel. The various ramifications and modifications of this technique are well known to those skilled in the art.

The endothermic gas is generally made by cracking natural gas in air to form CO and $H_2$. Natural gas is expensive, however, and its availability in some areas is uncertain.

Moreover, residual hydrocarbons in natural gas, such as propylene and butylene, are uncrackable. Thus as much as 0.1 to 1% uncracked hydrocarbon may be present in the endothermic gas during the displacement of air, causing soot to form on the workpiece.

The use of lower aliphtic alcohols, i.e., those having 1–4 carbon atoms, principally methanol, as a carrier gas in atmospheric carburizing furnaces avoids the disadvantages of endothermic gas. Methanol is readily available and, under the conditions which exist in carburizing furnaces, breaks down cleanly, forming pure $H_2$ and CO.

For example, Wyss, U.S. Pat. No. 3,201,290 teaches the use of such lower aliphatic alcohols as methanol and isopropanol as carrier gases. Solomon, U.S. Pat. No. 4,145,232 teaches a process of carburizing steel in a defined atmosphere comprising a carrier gas and a gaseous hydrocarbon, wherein the carrier may be endothermic gas or a nitrogen-methanol or nitrogen-ethanol mixture. It is also disclosed that, although nitrogen and methanol can be introduced separately into the carburizing chamber, they are usually introduced simultaneously.

The process disclosed in the Solomon patent requires a specific carburizing atmosphere having defined amounts of carbon monoxide, hydrogen, nitrogen, carbon dioxide, water vapor and hydrocarbon. The carburizing process is carried out in conventional carburizing chambers at atmospheric pressures with conventional seals.

The process described by the Solomon patent is disadvantageous in that it is an atmospheric process. Thus, air cannot be completely excluded from the furnace. Under carburizing conditions, air can combine with the other gases present and cause a dangerous explosive situation.

Moreover, atmospheric carburizing furnaces have stagnant areas. These stagnant areas do not allow fresh supplies of carburizing gas to flow around the workpiece, causing uneven cases with limited densities. Even when the gas is streamed over the workpiece, it is still not feasible to do so uniformly, especially when the workpiece is closely packed within the furnace.

Vacuum carburizing of steel is likewise known in the art and avoids the problems of atmospheric carburizing. For example, Westeren et al., U.S. Pat. Nos. 3,796,615 and Re. 29,881, Liurque et al., U.S. Pat. No. 4,168,186 and Novy et al., U.S. Pat. No. 4,160,680 teach methodology and apparatus for the carburizing and carbonitriding of steel under vacuum. The process, in essence, comprises evacuating the carburizing chamber, thus drawing air and oxygen away from the steel in the chamber. The steel is heated and the carburizing atmosphere is introduced into the furnace by a partial backfill of natural gas or propane. Cooling and/or quenching after carburizing may be provided by a recirculating cooling gas or by quenching means external to the carburizing chamber.

There is no teaching in any of the references which discloses an alcohol carrier gas to conduct carburization under vacuum instead of atmospherically. There is, likewise, no teaching in any of the references which discloses vacuum carburization to use an alcohol as the carrier gas. The need continues to exist, therefore, for a method of carburizing steel which avoids the problems due to the use of both endothermic gas as the carrier gas and atmospheric furnaces.

SUMMARY OF THE INVENTION

Accordingly, it is an object of the invention to provide a process of carburizing steel which combines the advantages of the use of methanol and vacuum carburization.

It is another object of the invention to provide a process for carburizing steel which results in a superior product characterized by having a minimal soot deposit on the surface and by an exceptionally uniform carbon content on the surface.

It is a further object of the invention to provide a process for carburizing steel which produces a product having the above-mentioned superior properties in a highly effective and efficient manner.

These and other objects, as will hereafter become clearer from the following discussion, have been attained by carburizing steel under vacuum by a process which comprises: introducing steel into a vacuum carburizing furnace; evacuating the furnace to remove air therefrom; raising the furnace temperature thereby removing residual oxygen or air from the surface of the steel; introducing an inert gas into the furnace; introducing an aliphatic alcohol having 1 to 4 carbon atoms as a carrier gas; introducing a measured amount of a natural gas into the furnace; and carburizing the steel. In a preferred embodiment of the invention, the furnace is backfilled with an inert gas during withdrawal of the steel. (usually nitrogen.)

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts through the several views and wherein.

DETAILED DESCRIPTION OF THE INVENTION

The process of the invention is useful in the carburizing of steel and those related processes, e.g., carbonitriding, bright hardening and the like, which are recognized by those skilled in the art as being similar.

The steel to be carburized in accordance with the process of the invention is generally low carbon steel except in the case of bright hardening, wherein the steel has an initial carbon content which is maintained during the process. Particularly preferred types of steel for carburizing by the process of the invention include, for example, steels containing AISI designations 1020, 1018, 1022, 1025, 8620 and 8630. Steel carburized or case hardened by the process of the invention is particularly useful in gears, camshafts, shells, cylinders and other items of manufacture which require a wear-resistant surface and tough core.

The vacuum furnace used to carry out the process of the invention is generally of a type conventional in the art. Generally, such furnaces comprise a shell or cylinder having one or more doors each of which is lined with suitable vacuum packing. The furnace is otherwise sealed, thus providing a vacuum chamber. The doors may be provided with a sighting port to permit observation during processing.

The furnace is equipped with suitable heating elements of conventional design, for example, spaced alloy metal corrugated strip type heating elements or graphite rods. The furnace is provided with external means such as a conventional vacuum pump for evacuating the chamber. The furnace is further provided with suitable inlets for the introduction of gases and with external sources of such gases. Means conventional in the art for introducing steel workpieces into the furnace and withdrawing them after carburizing are likewise provided.

The furnace may be equipped with means to introduce cooling gases into the furnace to reduce the temperature after carburizing and means external to the furnace for quenching the workpiece, e.g., a liquid quenching medium or an atmospheric quench. The furnace also contains circulating fan means to provide uniform circulation of the gases within the chamber during carburizing. Other particulars of construction, for example, temperature and pressure indicators, suitable support means for the steel workpiece and the like, which are recognized as conventional by those skilled in the art, are likewise provided.

Figure 2:
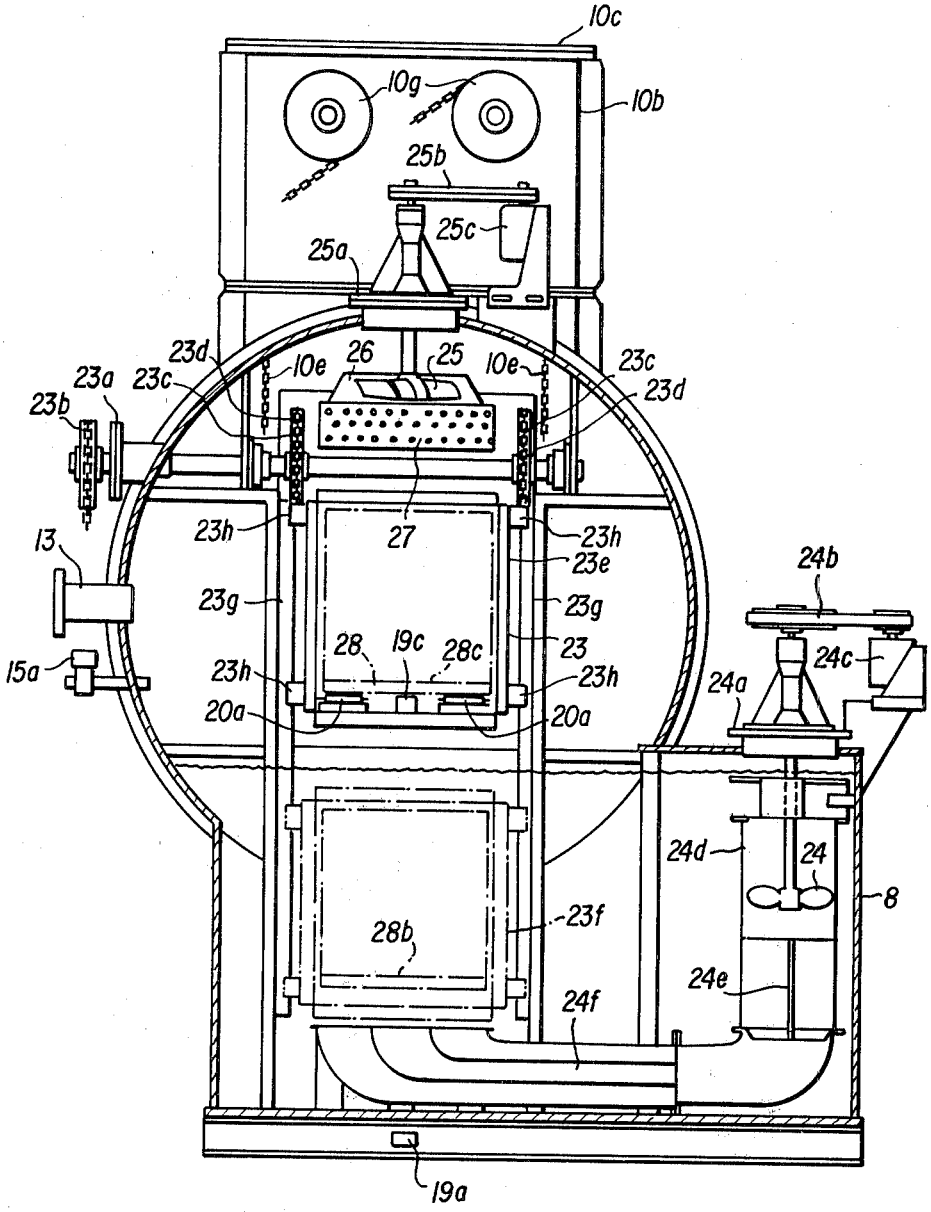
FIG. 2 shows the furnace assembly of FIG. 1, as seen along section 2—2.
Figure 3:
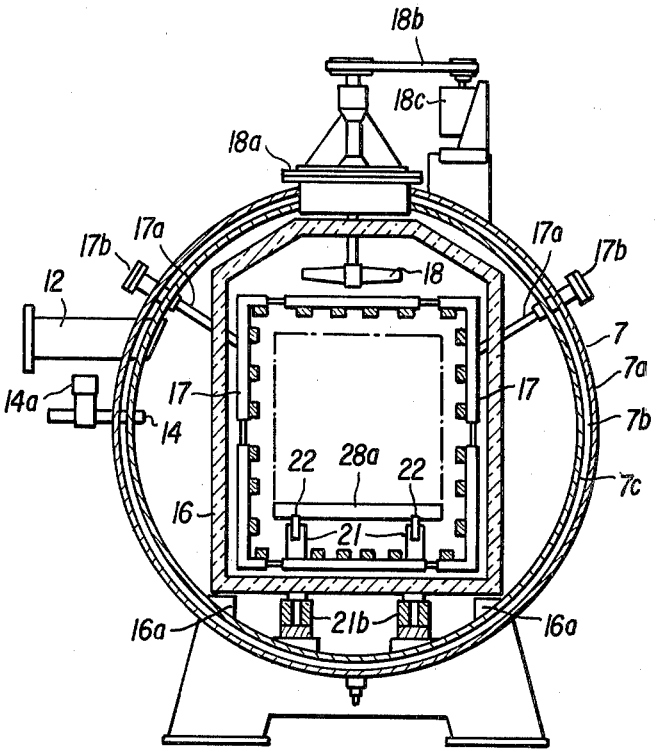
FIG. 3 shows the furnace assembly of FIG. 1 as seen along the section 3—3.

A furnace usable for carrying out the method of the present invention will now be described, with reference to FIGS. 1 through 3, in which similar reference numerals are used to describe similar elements throughout the several views.

The furnace consists of a vacuum tight assembly having three major chamber portions, a cylindrical shaped vacuum and atmospheric quench chamber 6, a hollow walled cylindrical shaped vacuum furnace 7 and a rectangular shaped oil quench tank 8. The vacuum and atmospheric quench chamber 6 has an opening at one end which is convered by a vacuum sealing front door 9, including a sight glass **9*a*. When the door 9 is opened, a work handling grid 28** may be introduced into the furnace.

The vacuum and atmospheric quench chamber 6 includes roller rails upon which the work handling grid 28 may roll during passage through the furnace. The roller rails 20 include a pair of fixed roller rail portions **19*b* adjacent the door 9, a pair of elevator deck roller rails 20*a* associated with the elevator, to be described hereinbelow, and a movable portion 20*b* associated with the bridge, also to be described hereinbelow. The work handling grid (shown in three positions as 28*a*, 28*b* and 28*c*) is moved through the quench chamber 6 by a snake chain (not shown) movable within a chain tube 19*a* and driven by a sprocket 19**.

Figure 1A:
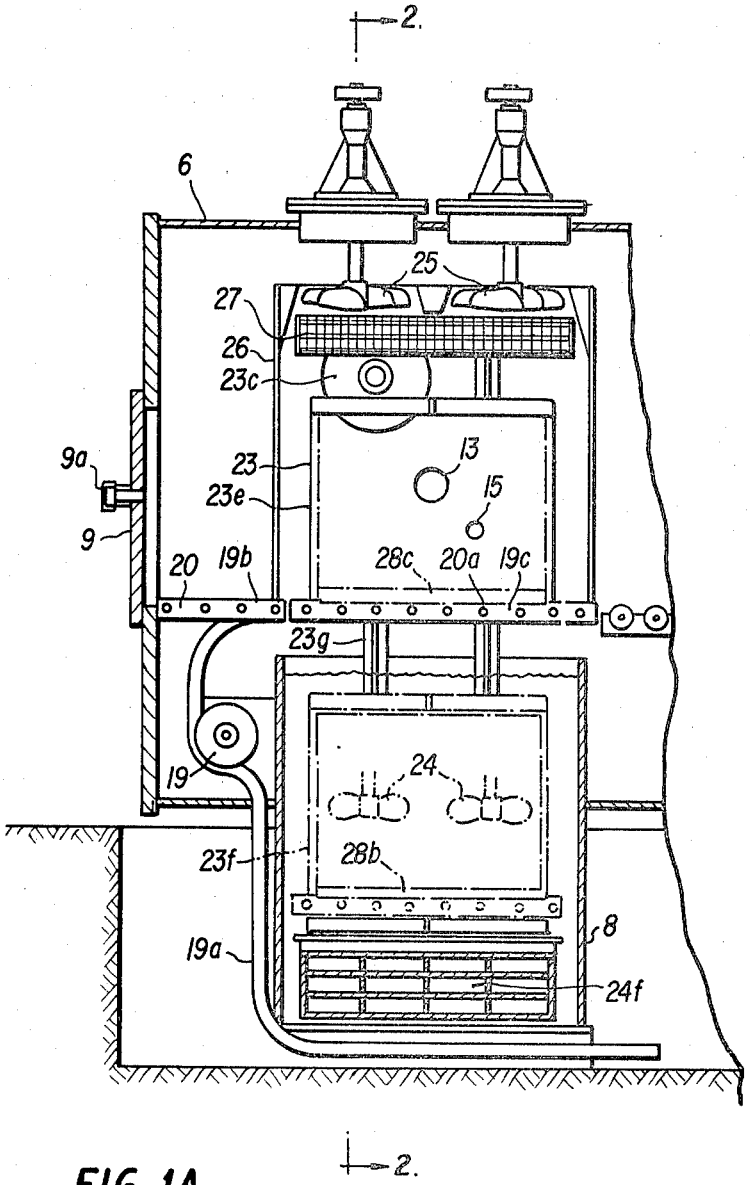
FIGS. 1A and 1B show a front view of the entire furnace assembly, in cross section.
Figure 1B:
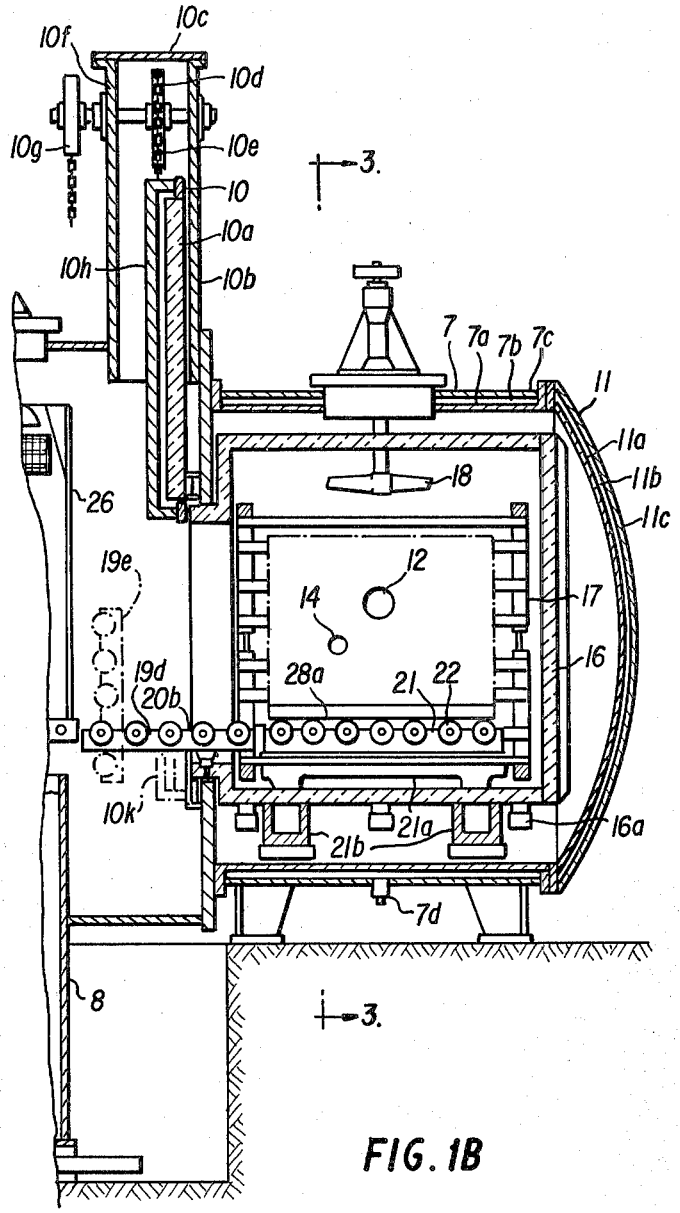

The elevator deck **19*c* is shown in the up position in solid lines, and in the down position in chain lines, in FIG. 1A. The work handling grid is shown at 28*c* on the elevator deck, while the work itself is shown in chain lines upon the work handling grid. The elevator deck 19*c* is part of the elevator assembly 23 which lowers the work handling grid from the quenching chamber to the oil quench tank 8, and includes the elevator, shown in the up position at 23*e*, elevator guide rails 23*g* fixed to the walls of the furnace assembly and elevator guide blocks 23*h* which are attached to the elevator and contact the elevator guide rails to ensure the proper guiding of the elevator in the vertical direction. A pair of elevator lift chains 23*d* connected to the elevator are wound around elevator lift sheaves 23*c* which are connected to the elevator drive sheave 23*b* through the elevator drive vacuum seal 23*a***.

Cooling of the work within the quench chamber 6 is accomplished by the water cooled finned tube heat exchanger 27, above which are located twin atmospheric cooling fans 25, driven by motor **25*c* through belts 25*b* and vacuum seals 25*a***.

The quench chamber includes a bridge pivotable between an up position **19*e* and a down position 19*d***. A vacuum sealed drive arrangement (not shown) is provided for pivoting the bridge between the up and down positions.

The chain tube **19*a*** passes through the elevator deck and the bridge.

Located below the quench chamber 6 is an oil quench tank 8 which may be filled with quenching oil and into which the elevator assembly may lower the work handling grid (shown as **28*b*** within the oil quench tank).

Circulation of the quenching oil around the work within the tank is provided by a pair of agitators 24 driven by motor 24c through belts 24b and vacuum seals 24a. The agitators 24 are contained within draft tubes 24d, each having flow straightening vanes in a lower portion thereof. A flow conduit 24f, including flow divider vane, arranged in an egg crate fashion, connect the draft tubes 24d to a portion of the tank located immediately below the work handling grid, so that oil is forced to flow arround the work.

A quench chamber vacuum port 13 connects the quench chamber to a source of vacuum while the quench chamber gas inlet 15, including valve 15a, provide gases to the quench chamber.

The hollow walled cylindrical shaped vacuum furnace 7 includes a water tight outer cylindrical shell 7c and an inner vacuum tight cylindrical shell 7a, defining therebetween a cooling water jacket 7b supplied by water lines including line 7d. Within the shell is an insulated casing module 16 having supports 16a and containing electrical resistance heating element assembly 17, including terminals 17a and 17b. A furnace table 21 is located within the insulation module 16 and includes a lower portion 21a which partially extends through the insulation 16 and is mounted to the casing, via insulation 21b. A pier support portion supports the distal end of the bridge in its down position 19d.

A furnace vacuum port 12 connects the interior of the furnace with a source of vacuum. The furnace gas inlet 14, and valve 14a, provide gas to the interior of the furnace.

A plurality of ceramic rollers 22 support the work handling grid (shown as 28a) within the furnace. The hot atmosphere within the furnace is recirculated by fan 18 which is driven by motor 18c through belt 18b and vacuum seal 18a.

Between the furnace 7 and the quench chamber 6 is located a combination insulated and vacuum sealed intermediate door 10 which may be lowered and raised by chains driven by lift sheaves 10d and 10e, which are in turn driven by the lift sheaves 10g through the vacuum seals 10f. The door, which is shown in is raised position as 10h and in its lowered position as 10k includes insulating material 10a. The door, when in its raised position, is contained within vacuum tight housing 10b having access cover 10c. When in the lowered position 10k, the door may be locked by a cam lock at the bottom thereof (not shown).

The work handling grid may be loaded and moved into the quench chamber from a cart or "pace car", either mechanically or manually. The snake chain, which includes a hook (not shown) for either pushing or pulling a load, then pushes the grid 28 into the furnace chamber 7. The bridge is then moved to position 19e and the door 10 is lowered to seal the furnace chamber 7.

In the process of the invention, the steel workpieces are placed in the furnace and the furnace is evacuated through vacuum port 12, for example, to a vacuum of from about 10 to about 600 microns, preferably about 50–100 microns. The air is withdrawn from the furnace so as to minimize oxygen contact with the surface of the steel workpiece. Contact with oxygen will cause scale, i.e., iron oxide, which has a detrimental effect on the carburizing, and can cause shorting of, or burn out, of the heating elements. Although a greater vacuum than about 10 microns can be created, it has been found that such greater vacuum is unnecessary since the furnace must be backfilled with gas and alcohol to create a partial pressure on the surface in order to achieve a carburizing medium once the air has been evacuated. On the other hand, the vacuum should not be less than 600 microns, since too much air will remain in the furnace, thus causing a potential detrimental effect to the carburizing process.

After evacuation of the furnace to the desired pressure, the temperature is raised to between about 1400° F. and about 2200° F., preferably about 1700° to 1900° F. by heating assembly 17. This heating step is carried out to drive any residual oxygen or air from the surface of the steel. Temperatures less than about 1400° F. are not sufficient to achieve the desired result and temperatures in excess of about 2200° F. are not desirable due to grain growth problems at higher temperatures. Such problems would affect the metallurgical structure of the steel being carburized. The removal of residual oxygen or air from the surface of the steel further acts to clean the parts. It is preferred that this temperature be maintained for from about 1 to about 3 hours, preferably about 2 hours.

The furnace is then backfilled with a suitable inert gas, e.g., nitrogen, argon, and the like through port 14. Of those inert gases recognized as conventional by those skilled in the art, nitrogen is preferred since it is readily available at comparatively low cost. Cryogenic nitrogen is especially preferred. By cryogenic nitrogen is meant nitrogen gas produced from liquid air.

The inert gas is backfilled into the furnace to a pressure of about 200 Torr to about 400 Torr, preferably about 300 Torr. Preferably, the inert gas should not be backfilled to a pressure less than about 200 Torr, in order to assure an inert atmosphere around the steel. In the case of nitrogen, backfill should not substantially exceed 300 Torr, as it is desirable to keep it to a practical minimum.

A measured amount of alcohol and natural gas or other gaseous hydrocarbons such as propane, butane or the like, is then added to the furnace through port 14. Usually an amount of alcohol and natural gas sufficient to raise the pressure by only from about 300 Torr to about 650 Torr, preferably about 600 Torr, is utilized.

The alcohol and the hydrocarbon may be added separately or both may be added together. It is preferable, however, that the alcohol and hydrocarbon be added separately. For example, if the inert gas is at a pressure of 300 Torr, the alcohol may be added until the pressure is raised to about 500 Torr. The hydrocarbon may then be added until the pressure is raised to about 600 Torr.

Alternatively, the alcohol and hydrocarbon can be added together until the pressure is raised from about 300 Torr to about 600 Torr.

It is important that the natural gas be added slowly to the furnace to minimize soot formation. For this reason, it is within the scope of the invention to begin introduction of the natural gas during backfill with the inert gas.

Addition of the desired amount of natural gas usually requires from about 0.25 hr to about 1 hour in order to minimize soot formation.

While a number of lower aliphatic alcohols having 1–4 carbon atoms, such as, for example, methanol, ethanol, propanol and the like, can be utilized, methanol is preferred.

During the carburizing process, the furnace is constantly being evacuated through vacuum port 12 by means of a vacuum pump, while at the same time fresh gases are supplied via port 14 to replace the spent gases.

The introduction of fresh gas in combination with evacuation of the furnace continually sweeps a large portion of the spent gas from the vacuum chamber. It will be appreciated by those skilled in the art that judicious placement of the inlet port 14 with regard to the vacuum outlet 12 will facilitate this effect. The pressure is controlled to from about 300 Torr to about 650 Torr, preferably about 600 Torr, and the temperature raised to between about 1400° F. to about 2200° F. Carburizing usually requires from about 1 to about 12 hours or more, preferably from about 2 to about 6 hours. Particular carburizing times will depend on the type of steel being carburized and the desired depth of the carbon deposit or case.

It has been found, in accordance with the invention, that the use of a lower aliphatic alcohol, preferably methanol, in combination with vacuum carburizing techniques provides an exceptionally effective and efficient carburizing process. The use of alcohol as a carrier gas in combination with vacuum techniques in accordance with the invention results in a carburizing atmosphere of about 20 to 33% carbon monoxide an about 40 to 66% hydrogen according to the following equation:

$$CH_3OH \rightarrow CO + 2H_2$$

The carbon monoxide in turn reacts with the hydrocarbon to produce nascent carbon atoms, which have an affinity for the iron present in the steel. The carbon is forced into the interstices of the surface of the steel, thus producing the case. The composition of the case may be generally described as iron carbide. The hydrogen present from the breakdown of alcohol acts as an endothermal carrier gas which sweeps the surface of the workpiece during carburizing, thus further minimizing soot formation. The depth of the case will vary with the factors such as the length of carburizing time, the temperature and the like. The depth of the case is adjusted according to the usage requirements of the steel. Generally, the case depth will be from about 0.010" to about 0.150" inches, depending on time and temperature.

At the end of the carburizing cycle, the carburizing atmosphere is removed from the furnace. The workpieces are withdrawn from the furnace by conventional means. During withdrawal, the furnace is backfilled with inert gas, preferably nitrogen, thus minimizing the amount of air which will enter during the withdrawal operation. The workpieces may be slow-cooled for later reheating and quenching, or may be directly gas fan quenching in chambers 6 or immersed in a liquid quenching bath, e.g., an oil bath 8.

The process of the invention produces steel having a heavy case which is characterized by an exceptionally uniform diffusion of carbon. The steel as it is withdrawn from the furnace is clean and bright due to the sweeping action of the circulating endothermic gas. Further, it has been found that the process of the invention produces case hardened steel of superior quality in a highly effective and efficient manner. The process gives a uniform case, produces less soot and results in cleaner steel parts than the prior art methods.

The following Examples are intended to further illustrate the invention and should by no means be construed as limiting the scope thereof.

EXAMPLE 1

A load of SAE #1144 steel was introduced into a vacuum furnace and heated to 155° F. under a vacuum of 10 Torr. The load was then soaked until optically blended, and carburized in a 342 minute cycle in the following sequence:

1. The quench chamber was backfilled to 700 Torr.
2. Nitrogen gas was added to the heating chamber, to 300 Torr.
3. Alcohol was added to the heating chamber to 500 Torr.
4. The heating chamber was backfilled with natural gas to 600 Torr.
5. The backfill was reduced to 550 Torr by the use of a cyclic pump for 4.5 seconds.
6. Natural gas ($CH_4$) was added for approximately 50 seconds, up to 600 Torr, and additional gas was cyclically added.

The load was diffused for 10 minutes with no gas additions after which the load was transferred from the heating chamber to the quench elevator, after equalizing the pressure between the furnace and quench chambers. The load was then quenched in oil for 10 minutes at 110° F. Finally, the load was lifted out of the quench tank, drained for 5 minutes and removed from the furnace assembly.

Figure 4:
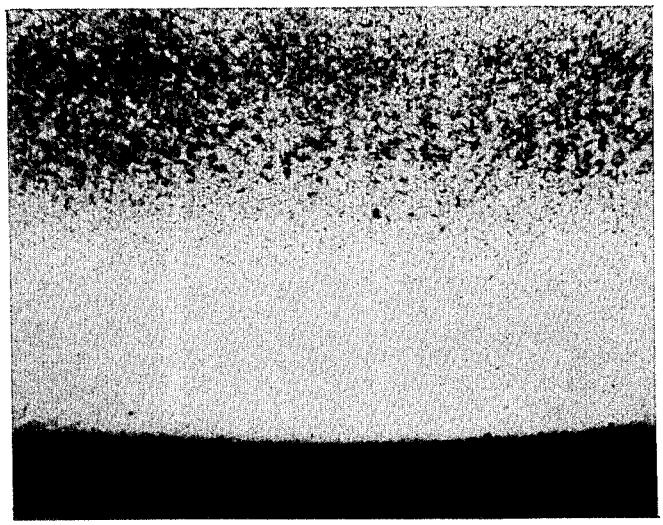
FIGS. 4–6 are photomicrographs showing the grain structure of steels treated according to the method of the present invention.

FIG. 4 is a micrograph of a cross section of the resulting steel magnified 50 times and etched with 2% Nital. The lighter area indicates a hard casing, while the darker area above the casing indicates a softer center. Table 1 shows that the hardness (Rc) of the steel decreases from 65.6 at a depth of 0.005 inches, to 47.6 at a depth of 0.035 inches.

EXAMPLE 2

A load of SAE #9310 steel (helicopter gears) was heated in a furnace to 1700° F. under a vacuum of 10 Torr. The load was then heat soaked until optically blended (about 15 minutes). The following 30 minute carburization cycle was then performed:

1. The heating chamber was backfilled with nitrogen to 300 Torr.
2. Alcohol was added to the heating chamber to 500 Torr.
3. The heating chamber was backfilled with natural gas to 600 Torr.
4. The pressure was reduced to 550 Torr by use of a cyclic pump for 4.5 seconds.
5. Natural enrichment gas ($CH_4$) was cyclically added for 50 seconds to a pressure of 600 Torr.

The load was then diffused for 30 minutes with no gas additions and cooled for 10 minutes in the heating chamber. Subsequently, the load was transferred from the heating chamber to the quench elevator, after equalizing the pressure. The load was atmospherically cooled on the elevator down to 250° F. and the cycle was repeated with a new load.

Figure 5A:
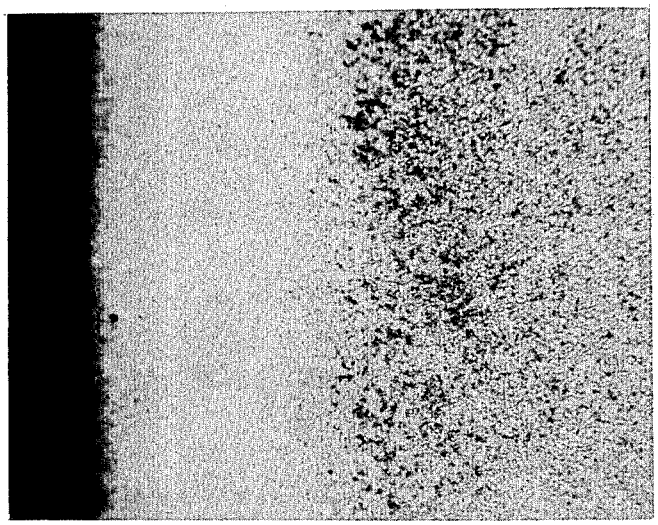
Figure 5B:
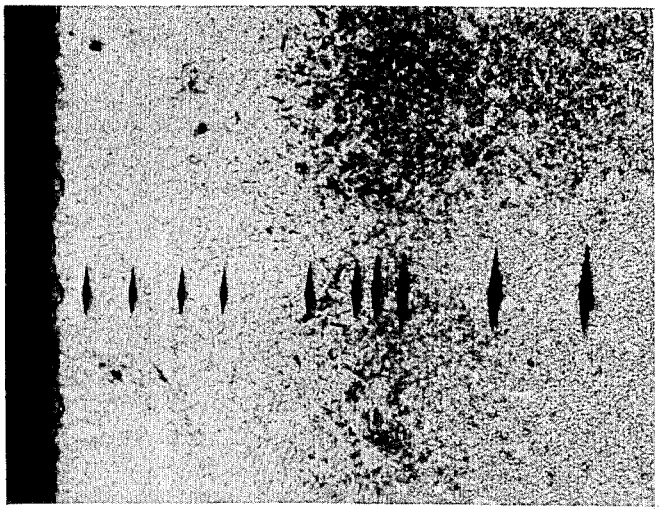
Figure 5C:
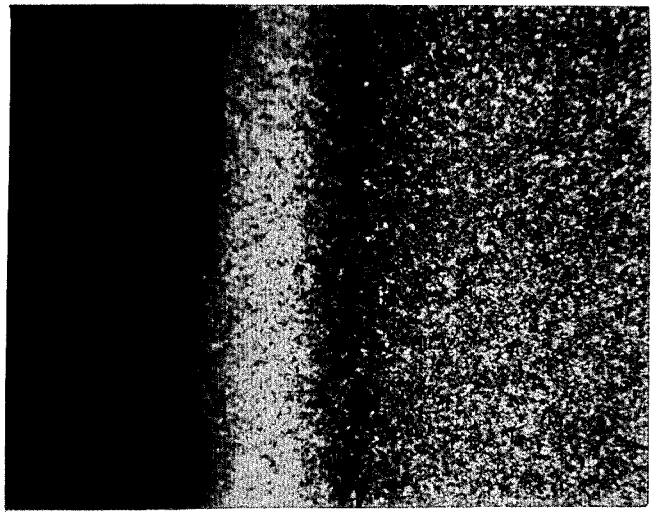

FIGS. 5A and 5B are micrographs of cross sections of the resulting steel, magnified 100 times, and etched with 2% Nital. FIG. 5C is a micrograph of the cross section of FIG. 5A, but magnified only 50 times. Again, the light area represents the case hardening, while the darker area represents the softer interior of the steel. As seen in Table 1, the hardness (Rockwell, "C" scale) ranged from 60.0 at a depth of 0.005 inches to 34.0 at 0.040 inches.

EXAMPLE 3

The same process as in Example 2 was carried out on SAE #9310 steel (helicopter gears) except that the carburization cycle lasted 90 minutes and the diffusion cycle lasted 90 minutes.

Figure 6A:
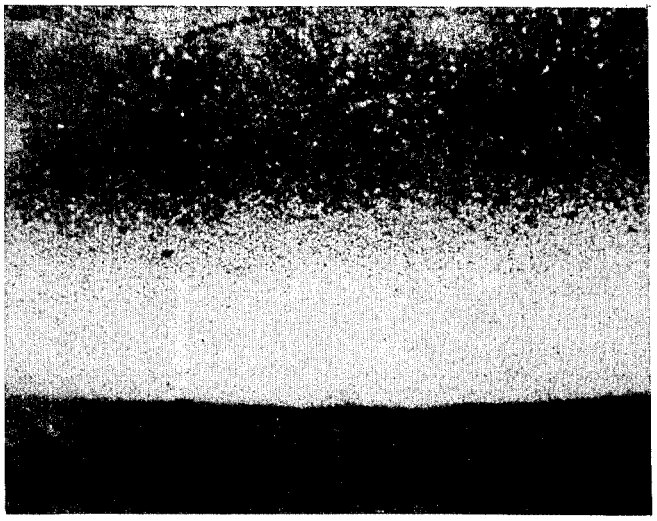
Figure 6B:
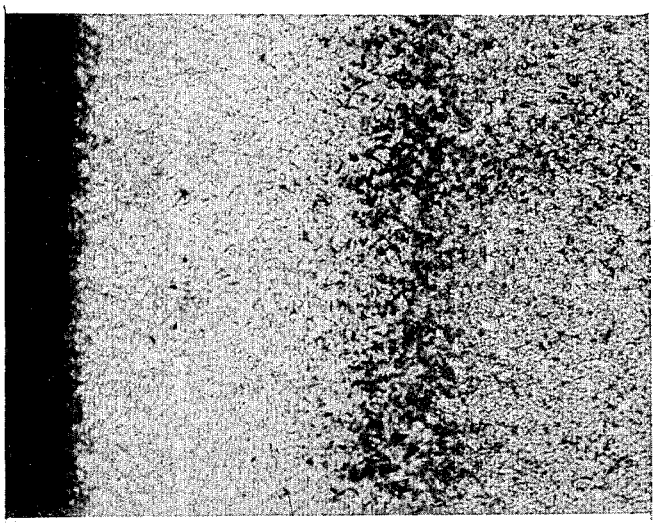

FIGS. 6A and 6B are micrographs showing cross sections of the resulting steel magnified 50 times and etched with 2% Nital. Again, the lighter portions represent the hardened case, while the darker portions represent the softer interior of the steel. As shown in Table 1, the hardness (Rc) ranges from 58.3 at a depth of 0.005 inches to 33.8 at a depth of 0.050 inches. As can be seen from Table 1, in all three examples, the hardness generally decreased as the depth from the surface increased.

TABLE 1

| Subject Depth inches | Hardness of Steel in Example 1 | Hardness of Steel in Example 2 | Hardness of Steel in Example 3 |
|---|---|---|---|
| .005 | 65.6 | 60.0 | 58.3 |
| .010 | 65.6 | 60.0 | 59.1 |
| .015 | 63.1 | — | — |
| .020 | 57.7 | 53.9 | 59.4 |
| .025 | 52.9 | 44.3 | 56.1 |
| .030 | — | 37.9 | 51.8 |
| .035 | 47.6 | 33.6 | 45.2 |
| .040 | — | 40.0 | 36.5 |
| .050 | — | — | 33.8 |

NOTE: All hardness values on Rockwell "C" scale.

It will be understood that various modifications in the hereindescribed process may be made without departing from the spirit and scope of the invention except as defined in the appended claims.

What is claimed as new and desired to be Secured by Letters Patent of the United States is:

1. A process for carburizing steel comprising carburizing said steel under vacuum in a vacuum furnace in the presence of a hydrocarbon carburizing agent while utilizing as a carrier gas an aliphatic alcohol having 1 to 4 carbon atoms, wherein fresh carburizing agent is supplied during said carburizing by cyclically reducing the pressure in the furnace followed by the addition of hydrocarbon carburizing agent to the furnace to replenish gas removed in the pressure reduction step.

2. A process in accordance with claim 1, comprising the steps of:

(a) evacuating the furnace to remove air therefrom;
(b) raising the temperature thereby removing oxygen or air from the surface of the steel;
(c) introducing an inert gas and an alcohol into the furnace;
(d) introducing a measured amount of a hydrocarbon containing gas into the furnace; and
(e) carburizing the steel.

3. A process in accordance with claim 1, wherein said aliphatic alcohol is methanol.

4. A process in accordance with claim 2, wherein, in step b, the temperature is raised to from about 1400° F. to about 2200° F.

5. A method in accordance with claim 2, wherein said inert gas is introduced to a pressure of from about 300 Torr to about 400 Torr.

6. A method in accordance with claim 1 or 2, wherein said aliphatic alcohol is introduced to a pressure of from about 300 Torr to about 500 Torr.

7. A method in accordance with claim 1 or 2, wherein the steel is carburized at a temperature of from about 1400° F. to about 2200° F.

8. A method in accordance with claim 2, further including the step of backfilling the furnace with said inert gas during removal of the steel.

* * * * *